United States Patent [19]

duPont

[11] Patent Number: 4,867,719

[45] Date of Patent: Sep. 19, 1989

[54] HYDROFOIL OAR WITH MOVABLE OUTRIGGER

[76] Inventor: Stephen duPont, 24 N. Casey Key Rd., Osprey, Fla. 34229

[21] Appl. No.: 252,174

[22] Filed: Sep. 30, 1988

Related U.S. Application Data

[63] Continuation-in-part of Ser. No. 10,585, Feb. 3, 1987, Pat. No. 4,776,821.

[51] Int. Cl.[4] ..... B63H 16/04

[52] U.S. Cl. ..... 440/101; 416/74; 440/13

[58] Field of Search ..... 440/101-108, 440/21, 13-17; 114/343, 363; 416/70 R, 74

[56] References Cited

U.S. PATENT DOCUMENTS 4,052,951 10/1977 Farr ..... 440/105

4,672,911 6/1987 Hodgins ..... 114/363

*Primary Examiner*—Joseph F. Peters, Jr.

*Assistant Examiner*—Edwin L. Swinehart

*Attorney, Agent, or Firm*—John R. Doherty

[57] ABSTRACT

A rowing apparatus comprising, in combination: a boat having a hull with fore and aft ends and an outrigger frame movably mounted onto the hull and having opposite ends projecting laterally outwards from each side of the hull. The apparatus further includes at least two oars located one on each side of the hull, each of the oars comprising an L shaped oarloom including two legs joined at an elbow, one of the legs constituting a handle loom having a generally athwartship position at mid-stroke and the other of the legs constituting a blade loom lying generally fore and aft to the boat hull at mid-stroke and having an outer end. A sweep hinge member is mounted onto each opposite end of the outrigger frame and is adapted to rotate about a substantially vertical axis, the sweep hinge member including an oarlock frame adapted to mate with the L shaped oarloom of one of the oars at about the elbow. A teeter hinge member is mounted to each oarlock frame and extends through the mating L shaped oarloom so as to permit rotation of the oarloom about a horizontal axis which is substantially coincident with a plane generally bisecting the right angle defined by the L shaped oarloom. A blade having a hydrofoil shaped surface is mounted to and below the outer end of each blade loom, the blade lying in a generally vertical plane which at mid-stroke is located at an angle with respect to the plane of the blade mounted to the oarloom on the opposite side of the hull.

20 Claims, 4 Drawing Sheets

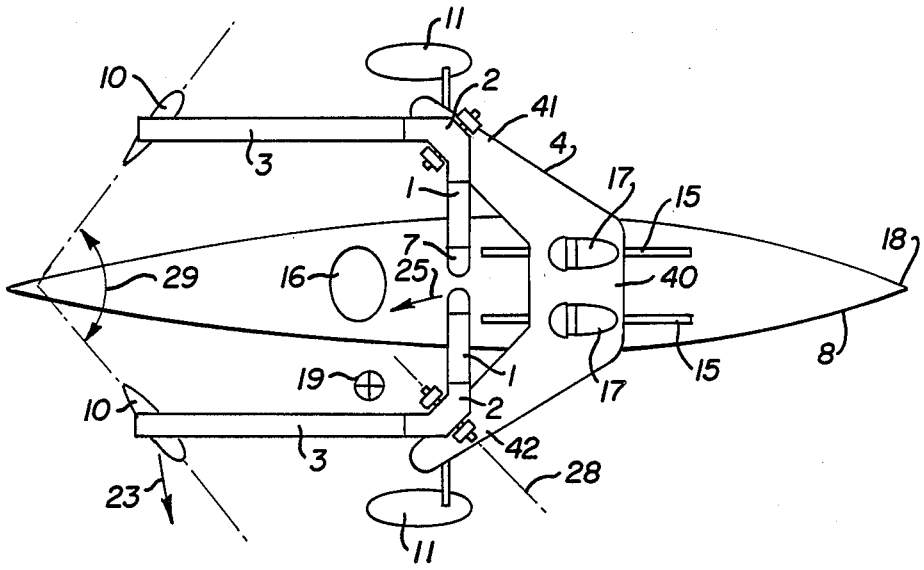
FIG. 1
FIG. 2
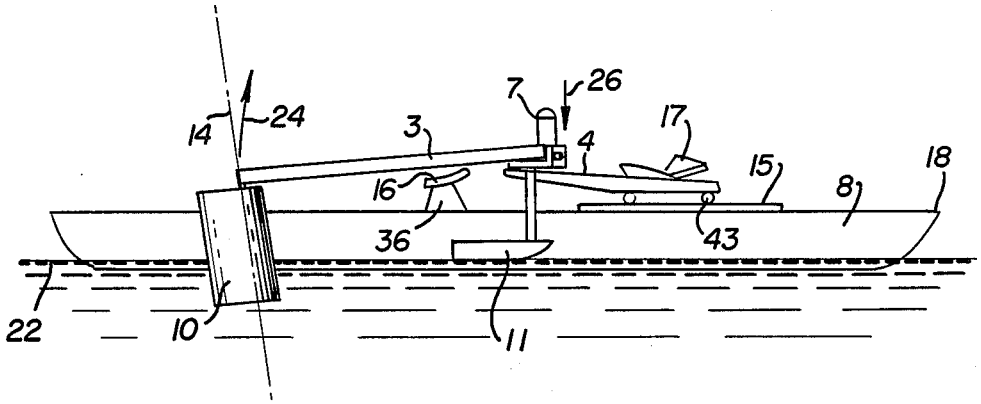

FIG. 3
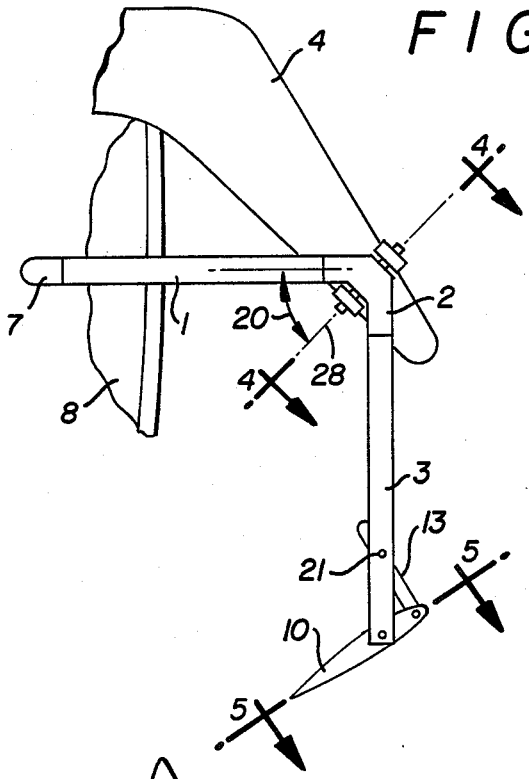
FIG. 4
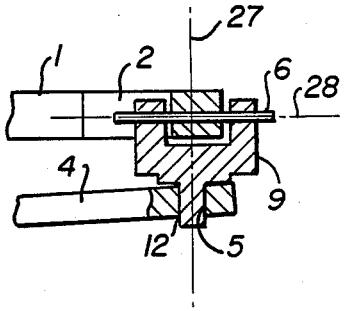
FIG. 6
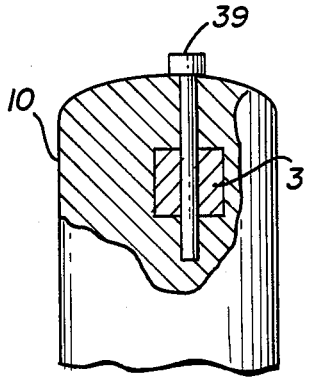
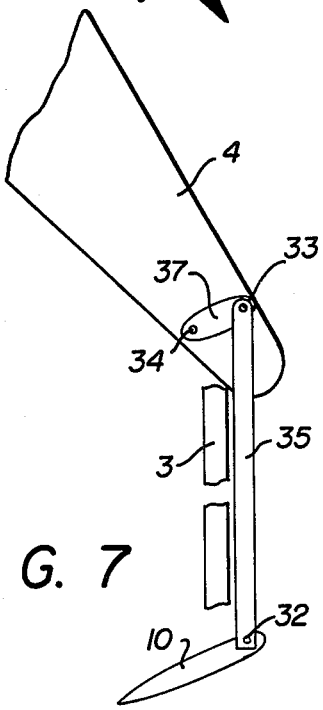
FIG. 7
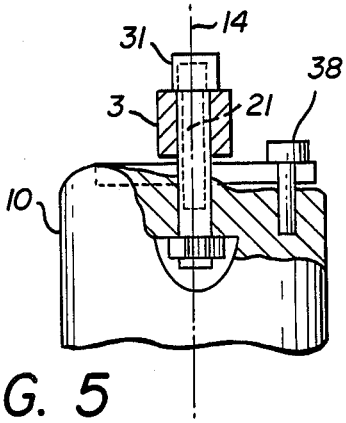
FIG. 5

HYDROFOIL OAR WITH MOVABLE OUTRIGGER

This application is a Continuation-in-Part of my earlier filed co-pending application Ser. No. 010,585, filed on Feb. 3, 1987.

Application Ser. No. 252,651, filed simultaneously herewith, and also a Continuation-in-Part of my above referenced co-pending application, contains subject matter related to this application.

BACKGROUND OF THE INVENTION

The present invention relates to improvements in high performance rowing apparatus.

Rowing for competition, recreation and exercise in specialized boats, called "shells", has existed for over a century, and is a respected international and Olympic sport as well as being popular in schools and clubs and with individual sportsmen.

Shells are very narrow boats having long waterline lengths to attain what is known as a high displacement-hull-speed and small surface area to reduce hydrodynamic friction drag. Outriggers extend laterally from the narrow hull to offer a wide support of the oarlocks for the purpose of reducing the angularity of the oars during the power stroke. The seats are mounted on rollers moving longitudinally to the boat on tracks, and the oarsman's feet are secured to the boat against rigid footboards by means of shoelike restraints or straps. The oars, called "sculls", where each oarsman uses two, and "sweeps", where each oarsman uses only one, are long and light and incorporate curved blades. The oars are pivoted in hinged oarlocks carried in sockets at the extremities of the outriggers. Shells have to be balanced laterally due to their narrow hulls and the top heavy position of the oarsman over the narrow hull by the static floatation of and by dynamic planing of the oar blades in the water. The oarsman sits facing backwards for the purpose of applying the most powerful muscles of the back, legs and arms from the foot stretchers to the oar handles during the power stroke in rowing. This backwards facing causes the oarsman to continually twist his neck and shoulders around to see forwards where he is going but most important to avoid running into obstacles including other boats. The twisting of the oarsman's neck and body restricts the free use of the important rowing muscles. The oar paddle blades produce thrust simply by pushing water backwards in the same direction of their backwards movement. It is well known that the paddle wheel steamer was less efficient than propeller driven steamers, because the paddle action is not as efficient a way of producing thrust as the angle of attack of propeller blades. The lateral span of the sculls and sweeps is very large, exceeding nineteen feet with today's sculls and twenty-four feet with sweeps, which results in excessive aerodynamic drag when rowing against the wind.

In my above referred to co-pending application Ser. No. 010,585, there is disclosed and claimed a high performance rowing apparatus wherein the rowing efficiency is improved by producing thrust through the use of a hydrofoil function of the blades instead of the paddle pushing action of conventional oars. The rowing apparatus comprises a boat having a hull with fore and aft ends and having an outrigger projecting laterally outwards from each side of the hull, and at least two oars located one on each side of the hull. Each of the oars comprises an L shaped oarloom including two legs joined at an elbow, one of the legs constituting a handle loom having a generally athwartship position at mid-stroke and the other leg constituting a blade loom lying generally fore and aft to the boat hull at mid-stroke and having an outer free end. A sweep hinge member is mounted onto each outrigger and is adapted to rotate about a substantially vertical axis, the sweep hinge member including an oarlock frame adapted to mate with the L shaped oarloom of one of the oars at about the elbow. A teeter hinge member is mounted to each oarlock frame and extends through the mating L shaped oarloom so as to permit rotation of the oarloom about a horizontal axis which is substantially coincident with a plane generally bisecting the right angle defined by the L shaped oarloom. A blade having a hydrofoil shaped surface is mounted to and below the outer end of each blade loom, the blade lying in a generally vertical plane which at mid-stroke is located at a divergent angle with respect to the plane of the blade mounted to the oarloom on the opposite side of the hull. The arrangement of the outrigger, oarloom and the hydrofoil blade is such that the blade will move laterally to the hull when the handle loom is moved in a direction longitudinal to the hull, the lateral movement of the blade, taken with its divergent angle with respect to the other blade, resulting in the hydrofoil surface of the blade moving through the water floating the hull in an angle of attack producing a thrust which is orientated generally normal to the direction of motion of the hydrofoil surface.

The oarsman rests on a seat which in the embodiment of my invention disclosed in the above referred to co-pending application is movably mounted to the hull in such a way as to place the oarsman on the aft side of each handle loom while facing the fore end of the hull. The seat is mounted on rollers which move along longitudinal tracks secured to the hull. The blade loom is positioned fore and aft of the hull but trails the elbow on the L shaped oarloom with the hydrofoil blade mounted to the aft end thereof. A pair of foot restraints are also mounted to the hull for securing the oarsman's feet of the while the oarsman's body moves longitudinally with the sliding seat during the rowing strokes.

BRIEF DESCRIPTION OF THE INVENTION

The present invention is directed to improvements in the rowing apparatus disclosed and claimed in my above referred to co-pending application wherein an outrigger is movably mounted onto the hull along with each oarloom and hydrofoil blade and wherein the seat is fixedly secured to the hull so that the oarsman's body remains stationary during the rowing operation. The rowing apparatus of the invention further includes foot restraints mounted onto the outrigger for securing the feet of the oarsman. The seat may be located on the aft side of the handle loom with the oarsman facing forwards or, alternatively, the seat may be located on the fore side of the handle loom with the oarsman facing rearwards toward the aft end of the hull. In addition, the oarloom may be mounted onto the sweep hinge member with the blade loom either leading or trailing the elbow in either position of the oarsman.

BRIEF DESCRIPTION OF THE DRAWING

The present invention will now be described in greater detail with particular reference to the accompanying drawing wherein like numerals refer to the same or similar parts and wherein:

FIG. 1 is a plan view of a boat and rowing apparatus according to one embodiment of the present invention;

FIG. 2 is an elevational view of the boat and rowing apparatus shown in FIG. 1;

FIG. 3 is an enlarged plan view of a part of the boat and rowing apparatus of FIG. 1 showing the mounting arrangement of the oars with the movable outrigger, teeter hinge bisecting the elbow, handle loom with handle, and blade loom with blade;

FIG. 4 is a sectional view taken along the line 4—4 in FIG. 3 showing the oarlock with sweep hinge and teeter hinge;

FIG. 5 is a sectional view taken along the line 5—5 in FIG. 3 showing the blade loom with adjustable incidence;

FIG. 6 is the same as FIG. 5 showing the blade loom with fixed incidence;

FIG. 7 is a view similar to FIG. 3 showing a modification for controlling the blade incidence;

DESCRIPTION OF THE PREFERRED EMBODIMENT

Figure 8:
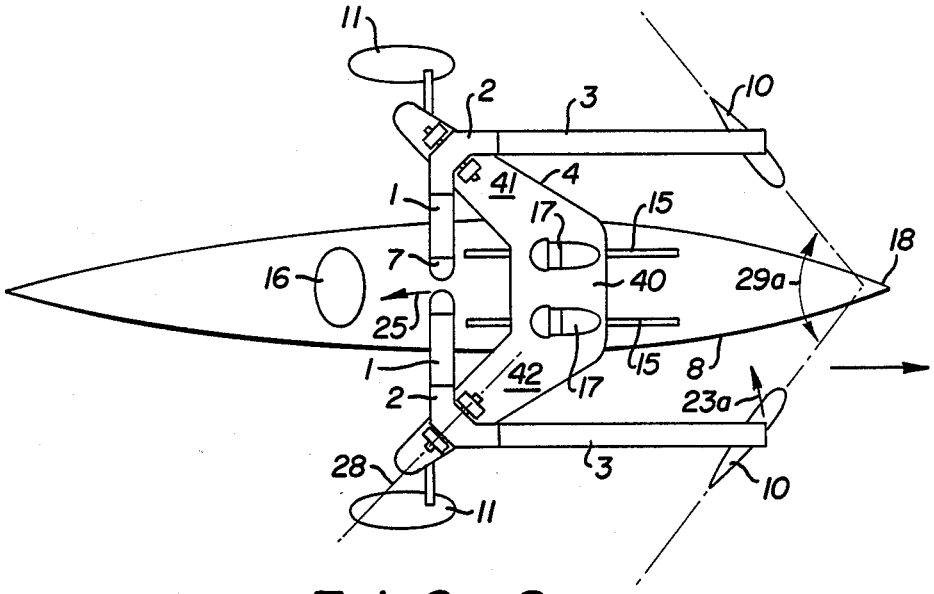
FIG. 8 is a plan view similar to FIG. 1 showing a boat and rowing apparatus according to another embodiment of the present invention.

The general arrangement of a shell equipped with a rowing apparatus according to one embodiment of the present invention is shown in FIGS. 1–7, inclusive, wherein the numeral 8 is the hull of the shell, 18 is the bow, 22 is the water line, 4 is a movable outrigger frame with rollers 43, 15 are longitudinal tracks for guiding the outrigger rollers, and 1 is the handle loom with the hand grip 7. The hand grip may be simply a properly sized and shaped protuberance to the oarloom fashioned from the loom material, or it may be a separate grip, and may be bearing mounted providing twist motion such as with motorcycle throttle control handlebar grips. As shown in FIG. 1 and 2, a trailing blade loom 3 has a hydrofoil shaped blade 10 attached to it and projecting downwards. The attachment of blade 10 to the aft end of blade loom 3 may be by rigid fixture to the blade loom or it may have a vertical axised rotation bearing mount to permit changing the angle of incidence of the hydrofoil blade relative to the loom centerline. This mount structure may provide by its design for the blade angle of incidence to be adjusted or it may provide for control of the blade angle through suitable linkages leading from the handle twist grip or a lever, neither of which is shown for simplicity, although the handle 7 in FIG. 3 does show a separate grip on the handle loom 1. Control from a twist grip handle is done in the common manner of twist grips on motorcycle handlebar and helicopter pitchsticks by levers and links, or by flexible cable in conduits or by sprockets and chains and so forth.

As shown in FIGS. 1 and 2, a pontoon 11 is mounted to each outer end of the movable outrigger frame 4 for balancing the narrow hull, and consists of a narrow float having a bottom shaped for hydrodynamic lift and for planing on the water. A loom elbow frame 2 is provided as shown in FIGS. 1 and 2 which can be made of suitable material such as metal or structural plastic and is rigidly structured to the legs of the oarloom and forms its approximately right angle elbow. As shown more particularly in FIG. 4, the oarlock frame 9 includes the oarlock hinge pin 6 for the teeter hinge that provides for pressing downwards or upwards on the handle as at 26 (FIG. 2) to raise or lower, in that order, the blade 10 in and out of the water as depicted by the arrow 24. This hinge pin 6 lies generally in a horizontal plane along the teeter axis 28, and also in a vertical plane parallel to a vertical plane that generally bisects the right angle of the loom elbow 2 as shown at 20 in FIG. 3. The purpose of the generally bisecting of the elbow is to provide support for the displaced center of gravity 19 of the L shaped oar assembly. As shown in FIG. 4, a pin 5 is provided for a sweep hinge of the oarlock and is structured to the oarlock frame. The pin 5 allows the oarlock frame to swivel in the socket 12 of the outrigger 4 about the sweep axis 27. The sweep hinge pivots and permits pulling and pushing of the handle loom 1 in the sweep action of rowing as shown by the arrow 25 in FIG. 1. This sweep action causes the trailing blade loom 3 to move laterally outwards, due to the elbow structure 2, as depicted by the arrow 23 in the unique thrust stroke of the present invention. The outwards movement of the hydrofoil blade 10, taken with its divergent forwards angle 29, results in the angle of attack of the moving foil being presented to the water to produce, similar to the action of a propeller blade, the thrust for propelling the boat. In FIG. 3, the restraint 13 is shown as one way of attaching the blade 10 to the blade loom 3 which allows adjustment by shifting the angular position of the blade 10 via an attachment fastening member 31, e.g. a screw, in holes 21. The other end of the restraint 13 is pivotally affixed to the blade 10 by a pin 38. In FIG. 5, the numeral 14 refers to the general vertical axis for incidence angle feathering of the blade during adjustment or control of its angle of incidence relative to the oarloom.

FIGS. 3 and 5 show one way of mounting the hydrofoil blade 10 where changes of incidence are desired. The blade mount incidence angle restraint 13 including adjustment screws 31 permits adjustment of the incidence relative to the blade loom 3, and which if interconnected to a linkage from a hand grip or a lever on the handle loom 1, controls blade incidence about axis 14 at the oarsman's will. FIG. 6 shows a typical blade mount where the angle of blade incidence is fixed by a screw pin 39 passing through the blade 10 and the blade loom 3.

FIG. 7 shows the blade incidence control linkage, wherein the numeral 35 is a link structure having one end 32 pivotally attached to the blade 10 and its other end 33 pivotally attached to a lever arm 37. The lever arm 37 is affixed to the outrigger via the pivot pin 34. A sprocket can substitute for the lever 37, and a pair of tension members such as chains or cables can substitute for the push-pull link 35 as has been described above.

In FIG. 1, the numeral 16 is the oarsman's seat and 17 are the foot restraints or stretchers. The oarsman's seat 16 is located aft of each handle loom 1 with the oarsman's body facing forward toward the fore end of the hull. The seat 16 is fixedly secured to the hull 8 such as by means of a vertical support 36 and the foot stretchers 17 are secured to the top of the movable outrigger frame 4.

The outrigger frame 4 is a continuous elongated structure having a mid-section 40 placed directly over the hull with its two outer ends 41 and 42 projecting laterally outwardly and rearwardly toward the aft end of the hull. The two outer ends of the outrigger carry the two sweep hinge members in sockets 12 as described above. The outrigger frame 4 is mounted on rollers 43 secured to the tracks 15 and moves longitudinally back and forth during rowing with the oarsman's feet secured to the outrigger by the foot restraints 17.

This arrangement of a fixed seat and movable outrigger with foot restraints according to the present invention results in the mass of the oarsman being fixed with the mass of the hull and reduces the cyclic change in hull speed during both the power and return strokes. The movable outrigger also provides an advantage in efficiency as a result of a reduction in the change of boat speed and gives the oarsman a more constant momentum and smoother result in force at his oar handles and foot restraints.

The rowing apparatus of the present invention has been described herein with particular reference to forward facing rowing as shown in FIGS. 1 and 2. However, it will be understood that the invention is not so limited and may be practiced as well with rearward facing rowing wherein the oarsman's seat is affixed to the hull at a location ahead of the handle looms while the oarsman's body faces rearwardly toward the aft end of the hull. Moreover, it will be understood that the oarloom may be mounted onto the sweep hinge member with the blade loom leading instead of trailing the elbow of each L shaped oarloom.

Such an arrangement is shown, for example, in FIG. 8 wherein the oarsman again rests on the seat 16 behind each handle loom 1 but in this case the blade loom 3 leads the elbow 2 with the blade 10 mounted beneath its fore end. The rowing apparatus is otherwise the same as that shown in FIGS. 1 and 2 except that the blades 10 are each mounted to the blade loom 3 with a divergent rearward angle **29*a* as depicted in FIG. 8. During the pull or power stroke, the sweep action of the oarlooms causes the blade loom 3 to move laterally inwards due to the elbow structure 2 as depicted by the arrow 23*a*. The inwards movement of the blade 10, taken with the divergent rearwards angle 29*a***, results in the angle of attack of the moving foil being presented to the water to produce thrust for propelling the boat.

Figure 9:
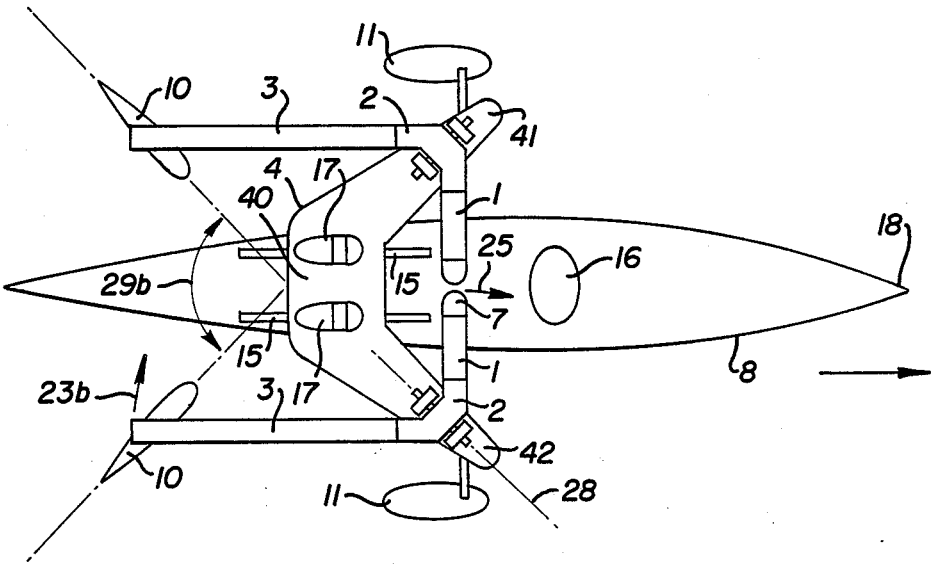
FIG. 9 is a view similar to FIG. 8 showing still another embodiment.

FIG. 9 shows another embodiment of the present rowing apparatus wherein the oarsman's seat 16 is affixed to the hull 8 at a location ahead of each handle loom 1 and wherein the blade loom 3 trails the elbow 2 with the hydrofoil blade 10 mounted beneath its aft end. The movable outrigger 4 is again mounted on rollers (not shown) which are secured in longitudinal tracks 15. The two outer ends 41 and 42 of the outrigger in this case extend outwardly and forwardly toward the fore end 18 of the hull. The oarsman faces rearwardly while resting on the seat 16 and during the pull or power stroke (see arrow 25), the sweep action so produced causes the blade loom 3 to move laterally inwards due to the elbow structure 2 as depicted by the arrow **23*b*. The inwards movement of the hydrofoil blade 10, taken with the divergent rearwards angle 29*b***, again results in the angle of attack of the moving foil being presented to the water to produce thrust for propelling the boat.

Figure 10:
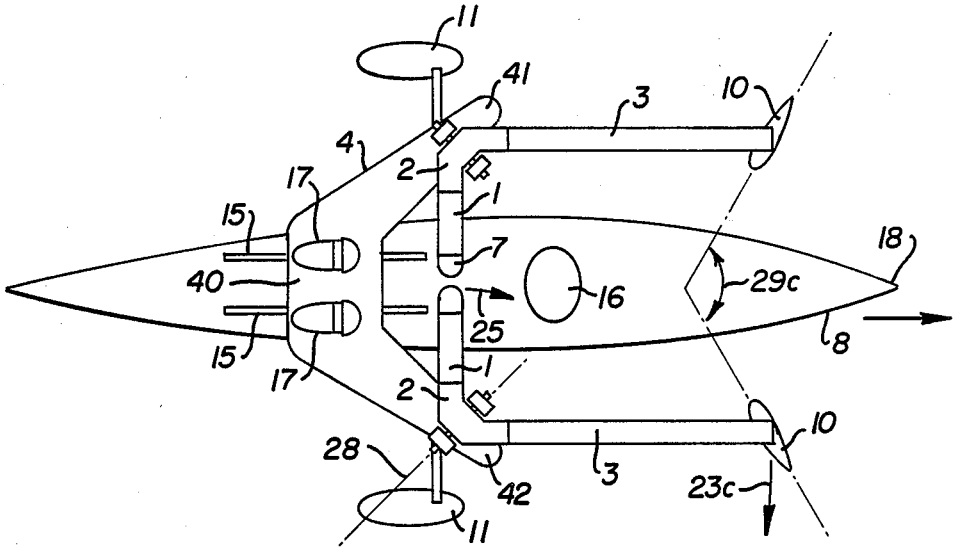
FIG. 10 is a view similar to FIG. 8 showing a further embodiment.

Another embodiment of the present rowing apparatus is shown in FIG. 10 wherein the oarsman's seat 16 is again affixed to the hull at a location ahead of the handle looms 1. However, in this embodiment, the blade loom 3 leads the elbow 2 with the hydrofoil blade 10 being mounted beneath the fore end thereof. The rowing apparatus is otherwise the same as that shown in FIG. 9 except that, in this case, during the pull or power stroke (see arrow 25), the sweep action causes the blade loom 3 to move laterally outwards as depicted by the arrow **23*c*. The outwards movement of the blade, taken with the divergent forwards angle 29*c***, again results in the angle of attack of the moving foil being presented to the water to produce thrust for propelling the boat.

The materials of construction are those normally used in the construction of boats, marine spars, oarlocks and the like, and include wood, aluminum, bronze, stainless steel, plastic (including that reinforced by glass and carbon fibers), and the newer man made high tensile fibers. Methods of construction are those well known in the marine construction industry for many years.

What is claimed is:

1. A rowing apparatus comprising, in combination: a boat having a hull with fore and aft ends and having a seat for the oarsman affixed to said hull, an outrigger having opposite ends projecting laterally outwards from each side of said hull, means for mounting said outrigger to said hull in a manner whereby said outrigger is able to move longitudinally along said hull, means affixed to said outrigger for securing the feet of said oarsman, and at least two oars located one on each side of said hull, each of said oars comprising an L shaped oarloom including two legs jointed at an elbow, one of said legs constituting a handle loom having a generally athwartship position at mid-stroke and the other of said legs constituting a blade loom lying generally fore and aft to the boat hull at mid-stroke and having an outer end, a sweep hinge member mounted onto each opposite end of said outrigger and adapted to rotate about a substantially vertical axis, said sweep hinge member including an oarlock frame adapted to mate with the L shaped oarloom of one of said oars at about said elbow, a teeter hinge member mounted to each oarlock frame and extending through the mating L shaped oarloom so as to permit rotation of said oarloom about a horizontal axis which is substantially coincident with a plane generally bisecting the right angle defined by said L shaped oarloom, and a blade having a hydrofoil shaped surface mounted to and below said outer end of each blade loom, said blade lying in a generally vertical plane which at mid-stroke is located at a divergent angle with respect to the plane of the blade mounted to the oarloom on the opposite side of said hull, the arrangement being such that said blade will move laterally to said hull when said handle loom is moved in a direction longitudinal to said hull, the lateral movement of said blade taken with its divergent angle with respect to said other blade resulting in the hydrofoil surface of said blade moving through the water floating said hull in an angle of attack producing a thrust which is oriented generally normal to the direction of motion of said hydrofoil surface.

2. A rowing apparatus according to claim 1, further including hydro lift means mounted to each opposite end of said outrigger, said hydro lift means being positioned vertically near the water line and laterally spread outwardly from the centerline of said hull.

3. A rowing apparatus according to claim 1, wherein the seat for the oarsman is affixed to said hull at a location such that the oarsman is positioned on the aft side of each handle loom while facing the fore end of said hull.

4. A rowing apparatus according to claim 3, wherein the blade loom of each oar leads said elbow with said blade mounted to the fore end thereof at a divergent rearwards angle with respect to the blade mounted to the oarloom on the opposite side of said hull.

5. A rowing apparatus according to claim 3, wherein the blade loom of each oar trails said elbow with said blade mounted to the aft end thereof at a divergent forwards angle with respect to the blade mounted to the oarloom on the opposite side of said hull.

6. A rowing apparatus according to claim 1, wherein the seat for the oarsman is affixed to said hull at a location such that said oarsman is positioned on the fore side of each handle loom while facing the aft end of said hull.

7. A rowing apparatus according to claim 6, wherein the blade loom of each oar leads said elbow with said blade mounted to the fore end thereof at a divergent forwards angle with respect to the blade mounted to the oarloom on the opposite side of said hull.

8. A rowing apparatus according to claim 6, wherein the blade loom of each oar trails said elbow with said blade mounted to the aft end thereof at a divergent rearwards angle with respect to the blade mounted to the oarloom on the opposite side of said hull.

9. A rowing apparatus according to claim 1, further including means for changing the angle of incidence of said blade with respect to the direction of travel of said blade through the water floating said hull.

10. A rowing apparatus according to claim 1, wherein the means for movably mounting the outrigger to said hull includes rollers secured to said outrigger and at least two longitudinal tracks affixed to said hull for guiding said rollers.

11. A rowing apparatus according to claim 1, wherein the means for securing the feet of said oarsman comprises foot restraints or straps.

12. A rowing apparatus according to claim 1, wherein the outrigger comprises a continuous elongated frame structure having a mid-section positioned over said hull with opposite ends projecting laterally outwardly from each side of said hull.

13. A forward facing rowing apparatus comprising, in combination: a boat having a hull with fore and aft ends, an outrigger frame positioned over said hull, said outrigger frame having a continuous structure with outer ends projecting laterally outwards from each side of said hull and having rollers secured thereto for movably mounting said outrigger frame onto said hull, elongated track means secured to said hull for guiding said rollers and allowing said outrigger to slide longitudinally along said hull, at least two oars located one on each side of said hull, each of said oars comprising an L shaped oarloom including two legs joined at an elbow, one of said legs constituting a handle loom having a generally athwartship position at mid-stroke and the other of said legs constituting a blade loom lying generally fore and aft to the boat hull at mid-stroke, a seat fixedly secured to said hull and adapted to position the oarsman on the aft side of each handle loom while facing the fore end of said hull, foot restraints mounted on said movable outrigger frame for securing the feet of the oarsman, a sweep hinge member mounted onto each outer end of said outrigger frame and adapted to rotate about a substantially vertical axis, said sweep hinge member including an oarlock frame adapted to mate with the L shaped oarloom of one of said oars at about said elbow, a teeter hinge member mounted to each oarlock frame and extending through the mating L shaped oarloom so as to permit rotation of said oarloom about a horizontal axis which is substantially coincident with a plane generally bisecting the right angle defined by said L shaped oarloom, a blade having a hydrofoil shaped surface mounted to and below the aft end of each blade loom, said blade lying in a generally vertical plane which at mid-stroke is located at a divergent angle with respect to the plane of the other blade mounted to the oarloom on the opposite side of said hull, the arrangement being such that said blade will move laterally to said hull when said handle loom is moved in a direction longitudinal to said hull, the lateral movement of said blade taken with its divergent angle with respect to said other blade resulting in the hydrofoil surface of said blade moving through the water in an angle of attack producing a thrust which is oriented generally normal to the direction of motion of said hydrofoil surface.

14. A forward facing rowing apparatus according to claim 13, wherein the blade loom of each oar leads said elbow with said blade mounted to the fore end thereof at a divergent rearwards angle with respect to the blade mounted to the oarloom on the opposite side of said hull.

15. A forward facing rowing apparatus according to claim 13, wherein the blade loom of each oar trails said elbow with said blade mounted to the aft end thereof at a divergent forwards angle with respect to the blade mounted to the oarloom on the opposite side of said hull.

16. A forward facing rowing apparatus according to claim 13, further including means for changing the angle of incidence of said blade with respect to the direction of travel of said blade through the water floating said hull.

17. A rearward facing rowing apparatus comprising, in combination: a boat having a hull with fore and aft ends, an outrigger frame positioned over said hull, said outrigger frame having a continuous structure with outer ends projecting laterally outwards from each side of said hull and having rollers secured thereto for movably mounting said outrigger frame onto said hull, elongated track means secured to said hull for guiding said rollers and allowing said outrigger to slide longitudinally along said hull, at least two oars located one on each side of said hull, each of said oars comprising an L shaped oarloom including two legs joined at an elbow, one of said legs constituting a handle loom having a generally athwartship position at mid-stroke and the other of said legs constituting a blade loom lying generally fore and aft to the boat hull at mid-stroke, a seat fixedly secured to said hull and adapted to position the oarsman on the fore side of each handle loom while facing the aft end of said hull, foot restraints mounted on said movable outrigger frame for securing the feet of the oarsman, a sweep hinge member mounted onto each outer end of said outrigger frame and adapted to rotate about a substantially vertical axis, said sweep hinge member including an oarlock frame adapted to mate with the L shaped oarloom of one of said oars at about said elbow, a teeter hinge member mounted to each oarlock frame and extending through the mating L shaped oarloom so as to permit rotation of said oarloom about a horizontal axis which is substantially coincident with a plane generally bisecting the right angle defined by said L shaped oarloom, a blade having a hydrofoil shaped surface mounted to and below the aft end of each blade loom, said blade lying in a generally vertical plane which at mid-stroke is located at a divergent angle with respect to the plane of the other blade mounted to the oarloom on the opposite side of said hull, the arrangement being such that said blade will move laterally to said hull when said handle loom is moved in a direction longitudinal to said hull, the lateral movement of said blade taken with its divergent angle with respect to said other blade resulting in the hydrofoil surface of said blade moving through the water in an angle of attack producing a thrust which is oriented generally normal to the direction motion of said hydrofoil surface.

18. A rearwards facing rowing apparatus according to claim 17, wherein the blade loom of each oar leads said elbow with said blade mounted to the fore end thereof at a divergent forwards angle with respect to the blade mounted to the oarloom on the opposite side of said hull.

19. A rearwards facing rowing apparatus according to claim 17, wherein the blade loom of each oar trails said elbow with said blade mounted to the aft end thereof at a divergent rearwards angle with respect to the blade mounted to the oarloom on the opposite side of said hull.

20. A rearward facing rowing apparatus according to claim 17, further including means for changing the angle of incidence of said blade with respect to the direction of travel of said blade through the water floating said hull.

* * * * *